US005638562A

United States Patent [19]

Masoncup

[11] Patent Number: 5,638,562

[45] Date of Patent: Jun. 17, 1997

[54] BED COVER STRUCTURE WITH AN IMPROVED DUST RUFFLE

[76] Inventor: John F. Masoncup, 610 N. Maple Ct., Mount Prospect, Ill. 60056

[21] Appl. No.: 327,296

[22] Filed: Oct. 21, 1994

[51] Int. Cl.[6] ..... A47G 21/00

[52] U.S. Cl. ..... 5/493; 5/482; 5/499; 5/486; 5/923

[58] Field of Search ..... 5/499, 500, 497, 5/486, 923

[56] References Cited

U.S. PATENT DOCUMENTS

| | | | |
|---|---|---|---|
| 2,641,001 | 6/1953 | Krasnov | 5/493 |
| 4,413,368 | 11/1983 | Schuetze | 5/923 |
| 4,445,242 | 5/1984 | Bowen | 5/923 |
| 4,488,323 | 12/1984 | Colburn | 5/923 |
| 4,651,370 | 3/1987 | Vitale | 5/500 |
| 4,916,766 | 4/1990 | Grandy | 5/496 |
| 5,086,531 | 2/1992 | Carlos | 5/493 |
| 5,271,112 | 12/1993 | Bidle et al. | 5/493 |
| 5,335,383 | 8/1994 | Schwind | 5/493 |

*Primary Examiner*—Steven N. Meyers
*Assistant Examiner*—Fredrick Conley
*Attorney, Agent, or Firm*—Charles F. Meroni, Jr.; Robert Toczycki

[57] ABSTRACT

A fitted bed sheet foundation and a dust ruffle for placement onto a mattress and around a box spring of a bed. The fitted bed sheet foundation comprises: a sheet of material, the sheet is sized to fit on and around corners and edges of a mattress, the sheet is of a sufficient size so that when it is laid over the mattress a lower edge of the sheet extends downwardly below and alongside the mattress with a lowermost edge area of the sheet positioned in confronting relation to a box spring, and a first fastener, the first fastener is secured at outer edges on the lowermost edge area of the sheet. The dust ruffle comprises: a sheet of dust ruffle material, the sheet of dust ruffle material is long enough to embrace sides of the box spring, a band of flat material, the band of flat material is attached along an upper edge of the dust ruffle material, and a second fastener, the second fastener is secured at inner edges along the upper edge of the band of flat material, the second fastener is spaced in such relation so that the second fastener located on the inner edge of the dust ruffle is securable to the first fastener located on the outer edge of the fitted bed sheet foundation and can then be tucked by a person's fingers a desired distance under the mattress in between the mattress and the box spring thereby providing a fitted bed sheet foundation and dust ruffle that is easy to install and remove on a mattress foundation.

22 Claims, 4 Drawing Sheets

BED COVER STRUCTURE WITH AN IMPROVED DUST RUFFLE

BACKGROUND OF THE INVENTION

1. Field of the Invention

The present invention relates generally to a bed sheet structure for placement onto a mattress and around a box spring of a bed. More particularly I have provided a bed sheet structure comprising a fitted bed sheet foundation and a dust ruffle being capable of installation on a mattress foundation to avoid any need to remove an upper mattress therefrom and to avoid any need for lifting the mattress foundation.

2. Description of the Prior Art

Conventional dust ruffles comprise a ruffled type skirt that is attached around the edges of a fitted sheet. The dust ruffle and fitted sheet are sized to be placed onto a lower mattress portion or a box spring of a bed. In order to install or remove a conventional dust ruffle from a bed, one must generally remove the upper mattress and lift the box spring. Dust ruffles are seldom removed from beds because of the difficulty involved in removing the upper mattress and lifting the box spring.

There have been various types of dust ruffles available in the marketplace, but none have gained widespread acceptance because of their difficulty of installation and removal. In addition, other types of dust ruffles require constant readjustment of the dust ruffle when the bed is made.

These and other types of bed sheet systems and dust ruffles disclosed in the prior art do not offer the flexibility and inventive features of my bed cover structure with an improved dust ruffle. As will be described in greater detail hereinater, the bed cover structure with an improved dust ruffle of the present invention differs from those previously proposed.

SUMMARY OF THE INVENTION

In accordance with one embodiment of my present invention I have provided a bed sheet structure comprising a fitted bed sheet foundation and a dust ruffle for placement onto a mattress and around a box spring of a bed. The fitted bed sheet foundation comprises: a sheet of material, the sheet is sized to fit on and around corners and edges of a mattress, the sheet is of a sufficient size so that when it is laid over the mattress a lower edge of the sheet extends downwardly below and alongside the mattress with a lowermost edge area of the sheet positioned in confronting relation to a box spring, and a first fastener, the first fastener is secured at outer edges on the lowermost edge area of the sheet. The dust ruffle comprises: a sheet of dust ruffle material, the sheet of dust ruffle material is long enough to embrace sides of the box spring, a band of flat material, the band of flat material is attached along an upper edge of the dust ruffle material, and a second fastener, the second fastener is secured at inner edges along the upper edge of the band of flat material, the second fastener is spaced in such relation so that the second fastener located on the inner edge of the dust ruffle is securable to the first fastener located on the outer edge of the fitted bed sheet foundation and can then be tucked by a person's fingers a desired distance under the mattress in between the mattress and the box spring thereby providing a fitted bed sheet foundation and dust ruffle that is easy to install and remove on a mattress foundation.

A further objective of this invention is to provide a bed sheet structure having hook and loop type fastening material to secure the fitted bed sheet foundation and the dust ruffle together.

A still further objective of this invention is to provide a bed sheet structure having loop type fastening material on the fitted bed sheet foundation and hook type fastening material on the dust ruffle.

Yet a further objective of this invention is to provide a bed sheet structure having hook and loop type fastening material to secure the fitted bed sheet foundation and the dust ruffle together, whereby when the fitted bed sheet foundation and the dust ruffle are secured together, the upper edge of the dust ruffle material and the lowermost edge area of the fitted bed sheet foundation can be tucked by a person's fingers a desired distance under the mattress providing a reverse bent edge on the band of flat material of the dust ruffle in between the mattress and the box spring, wherein the combination of the stiffness of the hook and loop type fastening material, the reverse bent edge on the band of flat material and a weight of the mattress create a more secure attachment between the hook and loop type fastening material and a resistance from pulling the dust ruffle out of an adjusted position.

Also an objective of this invention is to provide fasteners on the fitted bed sheet foundation that are aligned with fasteners on the dust ruffle whereby when the fasteners are secured together the dust ruffle is then properly aligned along an outer edge of a bed to the fitted bed sheet foundation.

Another objective of this invention is to provide a dust ruffle that extends along three edges of a box spring on an end of the box spring opposite to a head end of a bed.

Still another objective of this invention is to provide a sheet of dust ruffle material that has an external decorative configuration.

A further objective of this invention is to provide a sheet of decorative dust ruffle material that is wide enough to cover a space between a mattress and a supporting floor surface.

Yet another objective of this invention is to provide a fitted bed dust ruffle foundation that attaches to my dust ruffle wherein the fitted bed dust ruffle foundation comprises a sheet of flat material for placement on a mattress as a lowermost fitted sheet on a bed.

Also another objective of this invention is to provide a fitted mattress pad dust ruffle foundation that attaches to my dust ruffle wherein the fitted mattress pad dust ruffle foundation comprises a sheet of padded material for placement on a mattress underneath a fitted bed sheet for a bed.

A still further objective of this invention is to provide a fitted bed sheet dust ruffle foundation that attaches to my dust ruffle wherein the fitted bed sheet dust ruffle foundation comprises a sheet of flat material for placement on a mattress as an uppermost fitted sheet on a bed.

An even further objective of this invention is to provide a fitted bed sheet foundation with opposing lower edges that are slightly shorter in length than a length of the fitted bed sheet foundation and the opposing lower edges are centrally positioned along an outer edge of the fitted bed sheet foundation, thereby allowing a lowermost edge area of the fitted bed sheet foundation to be tucked in and removed from between the mattress and the box spring without disrupting an adjusted position of the fitted bed sheet foundation and also allowing space for a top bed sheet to be tucked in between the mattress and the box spring at a foot end of a bed.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
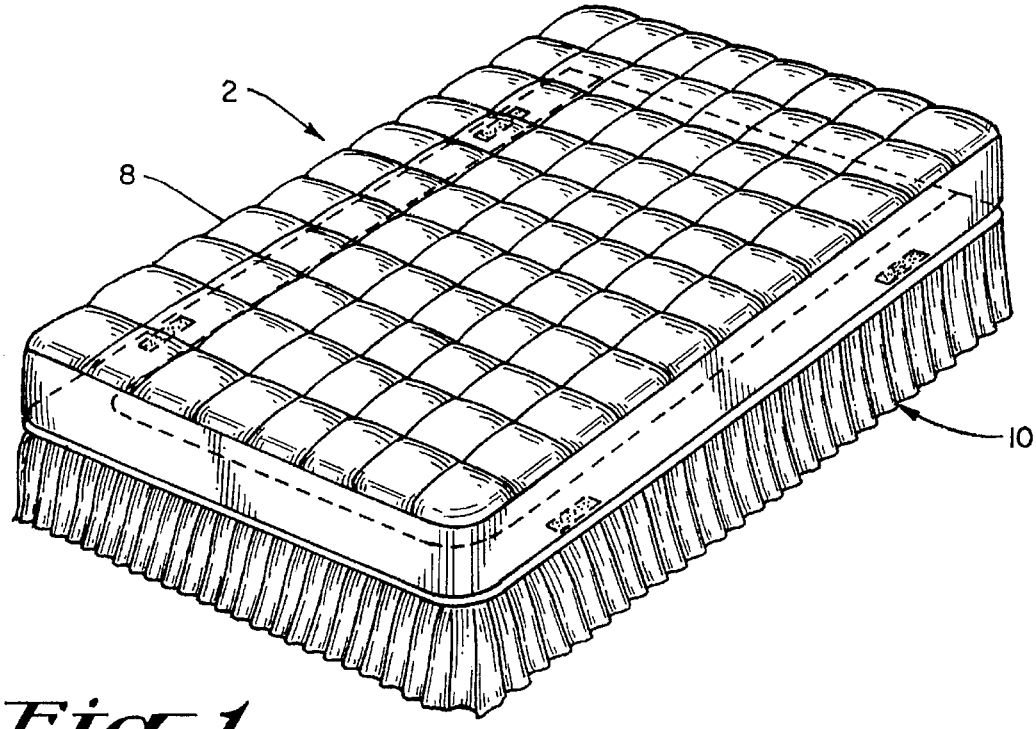
FIG. 1 is a perspective view of my fitted mattress pad foundation and dust ruffle in accordance with the present invention installed on a mattress foundation.
Figure 2:
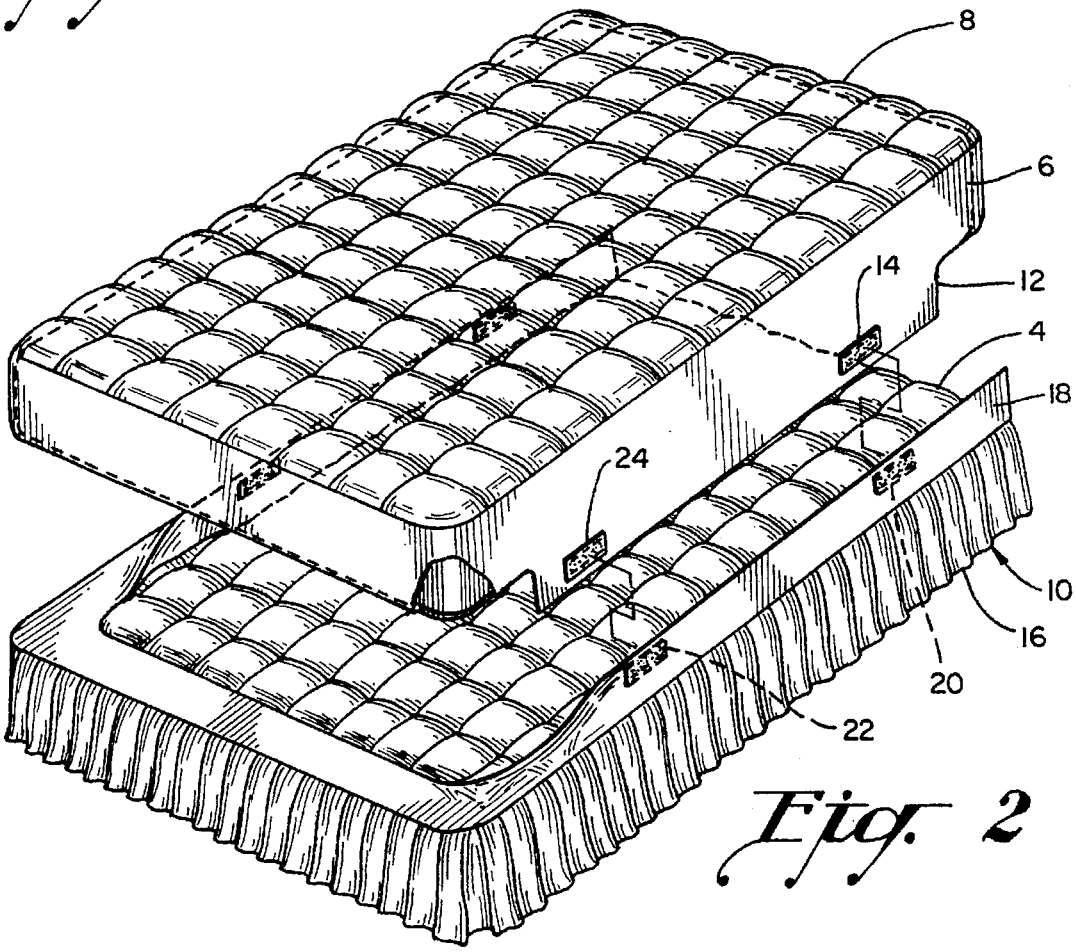
FIG. 2 is an exploded perspective view of my fitted mattress pad foundation and dust ruffle installed on a mattress foundation showing how the fitted mattress pad foundation and dust ruffle are attached together.

Referring now to the drawings, FIGS. 1 and 2 show my new and improved bed cover structure with an improved dust ruffle 2 installed on a mattress foundation. The mattress foundation comprises a lower mattress 4, such as a box spring, and an upper mattress 6. FIGS. 1 and 2 depict a fitted mattress pad foundation 8 attached to an upper mattress 6 and a dust ruffle 10 or dust ruffle structure 10 positioned around the lower mattress 4. The fitted bed sheet having first portions which are adapted to fit on and around the head and foot portions and elastically around the four corners of a mattress and second portions 12 adjacent the first portions and being separated from the first portions so as to be able to extend downwardly over a box spring while the first portions are in securement about a mattress that have first fasteners 14 attached to an outer lower end thereof. The second portions 12 are positioned on two opposing sides of the fitted mattress pad foundation 8. Excellent results are obtained when the extended side panels 12 are slightly shorter in length than the length of the fitted mattress pad foundation 8 and when the extended side panels 12 are centrally positioned along the outer edge of the mattress pad foundation 8. By having shorter, centrally positioned extended side panels 12, the extended side panels 12 can be tucked in and removed from between the upper mattress 6 and the box spring 4 without disrupting the adjusted position of the fitted mattress pad foundation 8. In addition, by providing shorter extended side panels 12 on my fitted mattress pad foundation 8, additional space is provided at a foot end of the mattress foundation to tuck a top bed sheet in between the upper mattress 6 and the box spring 4. The fitted mattress pad 8 is sized to fit on varying widths of conventional mattresses, typically between 9 to 12 inches in width. Where the mattress size falls within the range of 9 to 12 inches in width, the extended side panels 12 are long enough to extend alongside the box spring 4 regardless of the width of the upper mattress 6.

The dust ruffle 10 or dust ruffle structure 10 comprises a sheet of dust ruffle material 16 and a band of flat material 18. The length of the dust ruffle 10 is sized to fit around the three ends opposite to a head end of a bed. My dust ruffle 10 does not extend around the head end of a bed since attachment on the head end side is more difficult by requiring one to lift or move the upper mattress, in addition, the dust ruffle is not normally visible on a bed having a head piece.

Figure 3:
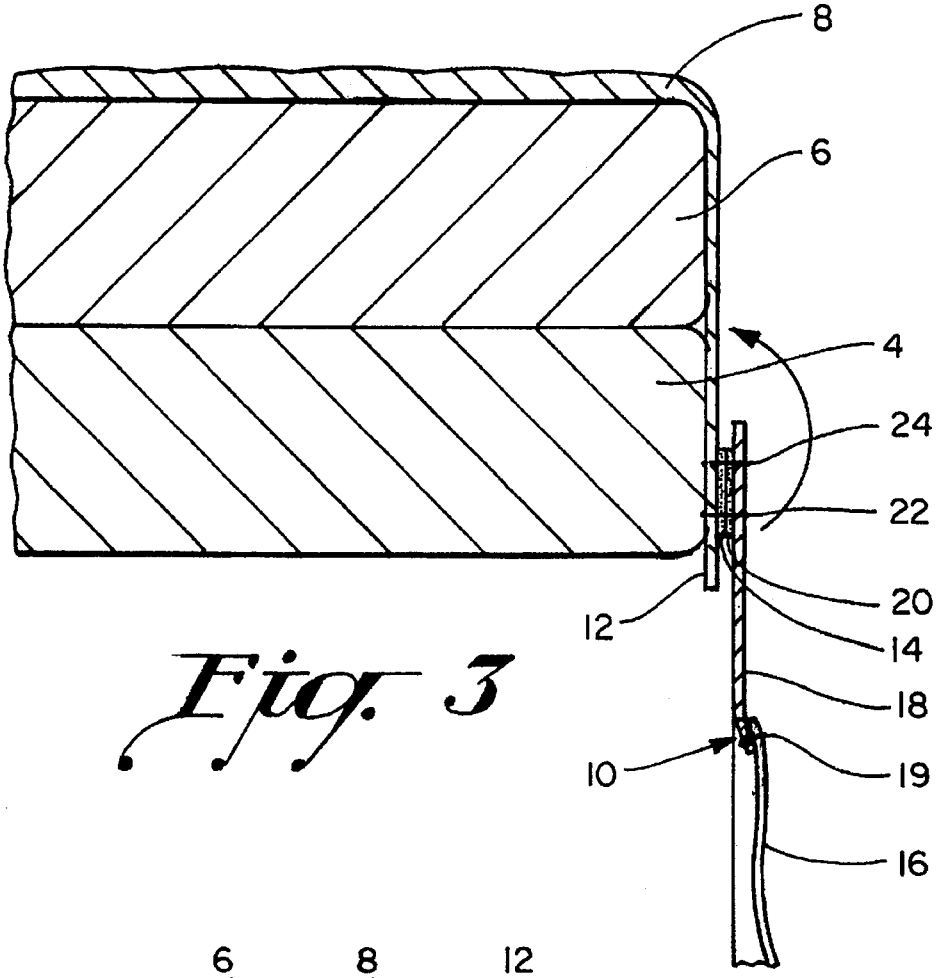
FIG. 3 is an enlarged partial cross-sectional view showing how my fitted bed sheet foundation and dust ruffle are attached together and installed on a mattress foundation.
Figure 4:
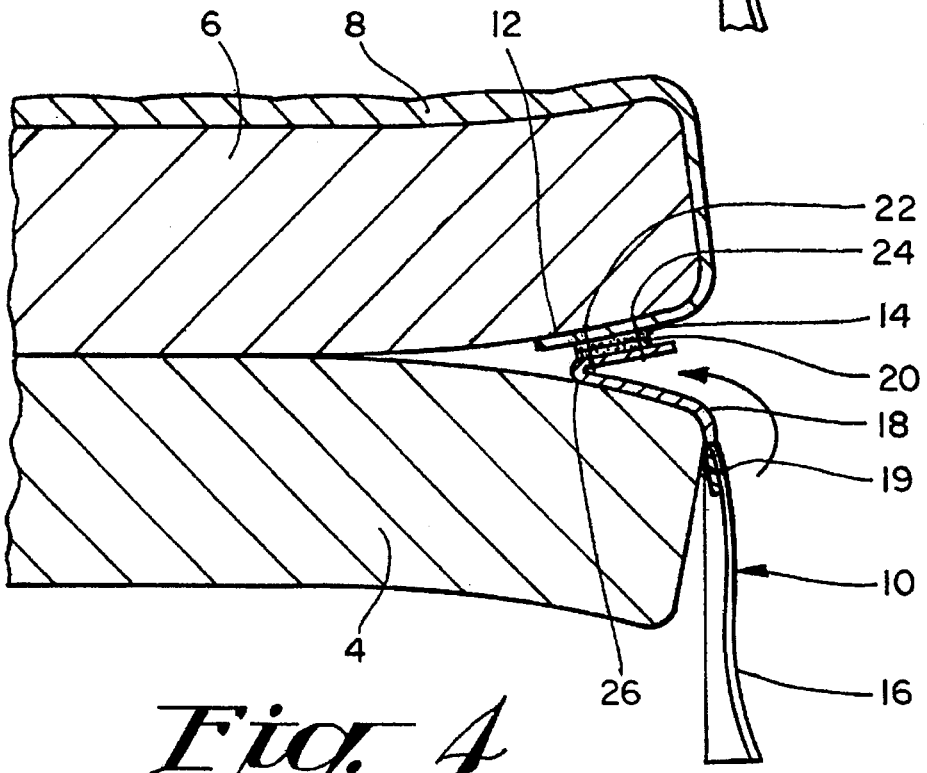
FIG. 4 is an enlarged partial cross-sectional view showing how my fitted bed sheet foundation and dust ruffle are installed and tucked into a mattress foundation.

The band of flat material 18 is attached along an upper edge of the dust ruffle material 16, preferably by stitching 19 (FIGS. 3 and 4). Second fasteners 20 are attached along inner upper edges of the band of flat material 18. The fasteners 14 and 20 are aligned in such a way that the dust ruffle 10 will properly align with the fitted mattress pad foundation 8. Excellent results are obtained when the fasteners 14 and 20 are of a matable hook and loop type material, such as the hook and loop fastening structures manufactured under the registered trademark "VELCRO". Typical fasteners of the so-called "VELCRO" type are shown in U.S. Pat. Nos. 3,658,107 and 3,732,600. These fasteners 14 and 20 can be attached to the band of flat material 18 and extended side panels 12 by stitching 22, 24 (FIGS. 2, 3 and 4). Typical VELCRO fasteners have a desired stiffness and resist bending when joined together.

FIGS. 3 and 4 further depict how my dust ruffle 10 is attached to the fitted mattress pad foundation 8. After the fitted mattress pad foundation 8 is placed on the upper mattress 6, the dust ruffle 10 is attached by its fasteners 20 to the fasteners 14 on the extended side panel 12 of the fitted mattress pad foundation 8 (FIG. 3). The fastened extended side panels 12 and the band of flat material 18 can then be tucked by a person's fingers a desired distance under the upper mattress 6 in between the upper mattress 6 and the box spring 4. By tucking the fastened sheets 12 and 18 in between the upper mattress 6 and the box spring 4, a reverse bent edge 26 is created. The combination of the reverse bent edge 26, the weight of the upper mattress 6 and a stiffness of the fastener parts creates a more secure attachment of the fastener components and helps to resist the fastened sheets 12 and 18 from being pulled out from in between the mattress 6 and the box spring 4. This secure attachment enables the dust ruffle 10 to remain in proper position without having to re-adjust the dust ruffle every time the bed is made.

My bed cover structure with an improved dust ruffle is easily installed by placing my fitted mattress pad foundation 8 onto an upper mattress 6. The mattress pad foundation 8 is sized to fit the size bed being made. The mattress pad foundation 8 is fitted to engage all four corners of the upper mattress 6. The extended side panels 12 are then positioned alongside the box spring 4 with the fasteners 14 exposed on the outer edge of the extended side panels 12. The dust ruffle 10 is then attached around three edges of the bed by securing the fasteners 20 on the band of flat material 18. The secured edges are then tucked in between the upper mattress 6 and the box spring 4 thereby providing a decorative dust ruffle on a bed cover structure.

Figure 5:
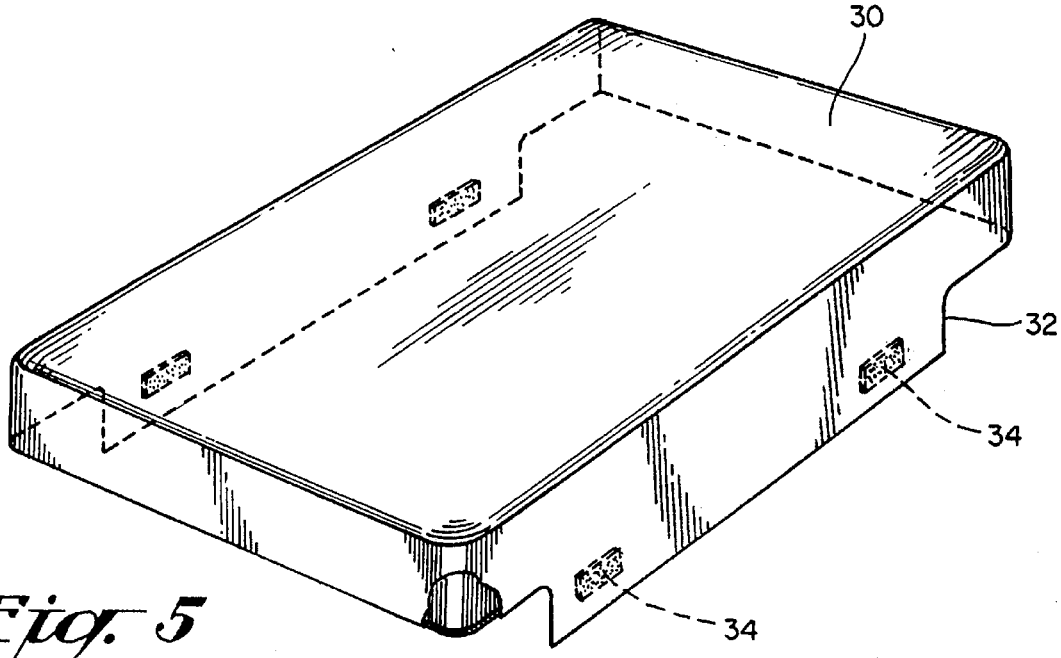
FIG. 5 is a perspective view of my fitted bed sheet foundation in accordance with the present invention installed on an upper mattress.
Figure 6:
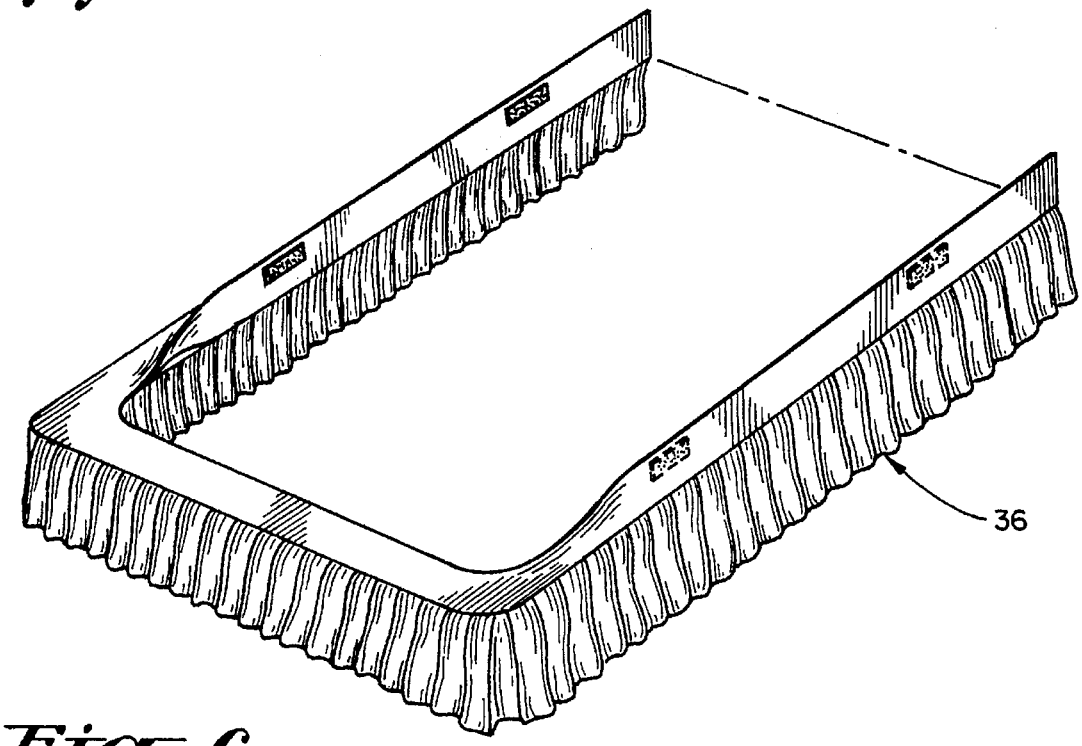
FIG. 6 is a perspective view of my dust ruffle in accordance with the present invention.

FIGS. 5 and 6 show another embodiment of my new and improved bed cover structure with an improved dust ruffle 2 installed on a mattress foundation. A fitted bed sheet foundation 30 can also be used instead of a mattress pad foundation as was outlined above. The fitted bed sheet foundation 30 also has extended side panels 32. The extended side panels 32 also have fasteners 34 attached at lower ends thereof. The dust ruffle 36 is the same dust ruffle as previously outlined and is secured to the fitted bed sheet foundation 30 the same way it can be secured to the fitted mattress pad foundation.

Figure 7:
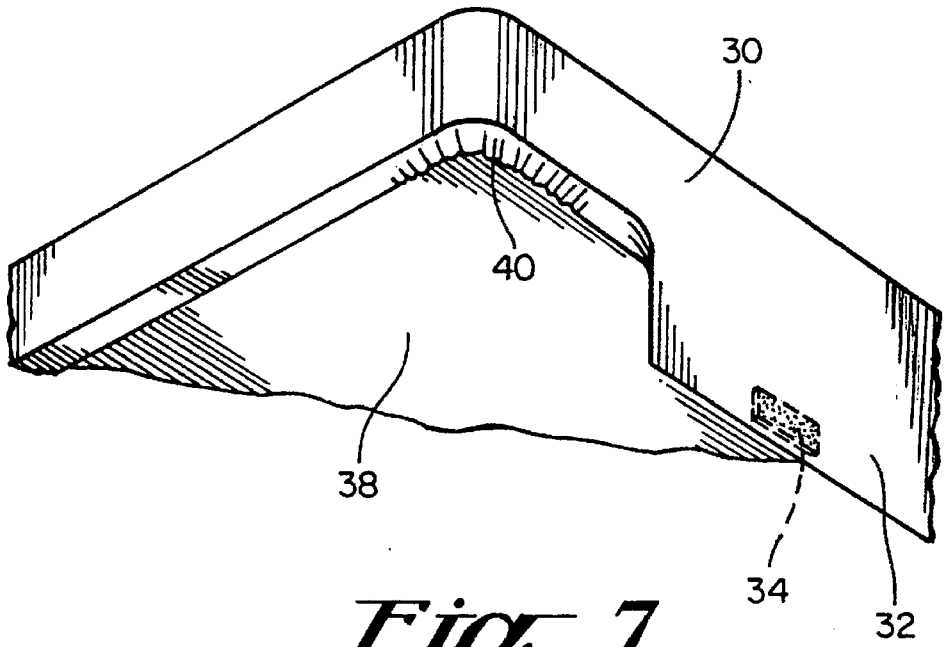
FIG. 7 is a partial bottom perspective view of my fitted bed sheet foundation in accordance with the present invention installed on an upper mattress.

FIG. 7 shows how my fitted bed sheet foundation 30 is secured to the upper mattress 38 using elastic corners 40 as are conventionally used on fitted bed sheets. The elastic corners 40 make it easier and quicker to install the fitted bed sheet foundation 30 onto an upper mattress 38. FIG. 7 further illustrates how my fitted bed sheet foundation 30 has extended side panels 32 that extend down between a bed and can then be tucked in between the upper mattress and the box spring.

Figure 8:
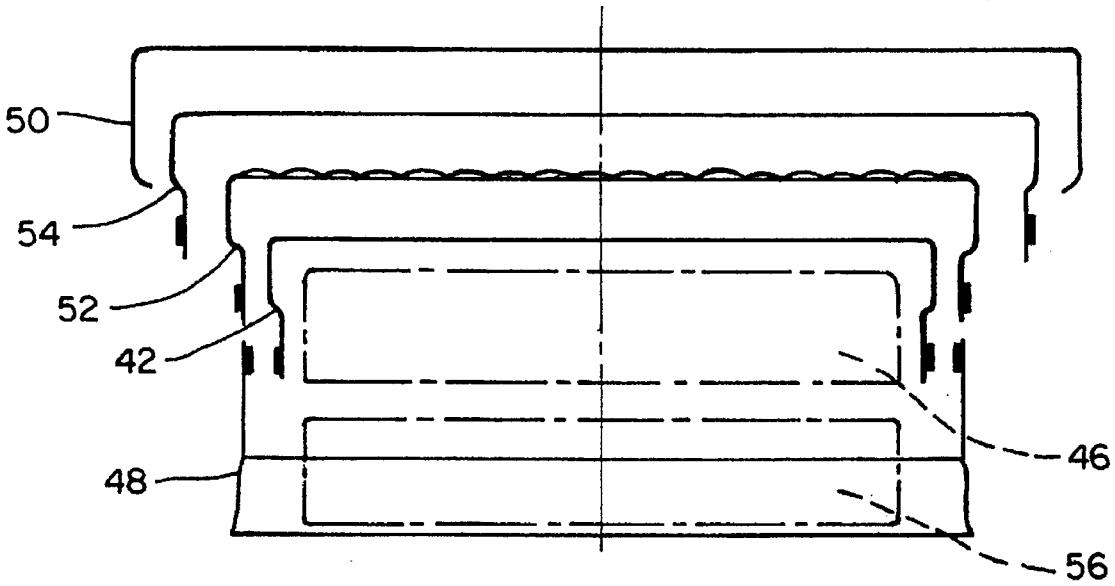
FIG. 8 is a diagrammatic edge view showing a mattress plus box spring and how any one of the following can be selectively mounted on a mattress including (1) a dust ruffle foundation (2) a mattress pad foundation and (3) a fitted sheet foundation, plus their relationship to the dust ruffle and box spring.

My fitted bed sheet foundation and my fitted mattress pad foundation can be used on a bed in various different ways. FIG. 8 shows the different ways my bed cover structure with an improved dust ruffle can be used. A fitted dust ruffle foundation 42 can be installed on an upper mattress 46 and can then be left on the bed at all times to use as a base for installing different types of dust ruffles 48. A fitted bed sheet 50 can be placed on top of my fitted dust ruffle foundation 42 thereby eliminating a need for one to remove the fitted dust ruffle foundation 42 and the dust ruffle 48 when the fitted bed sheet 50 needs to be washed and/or replaced.

Another way my bed cover structure with an improved dust ruffle can be used is to install my fitted mattress pad foundation 52 on the upper mattress 46 and then a fitted bed sheet 50 can be placed over the fitted mattress pad foundation 52. A third way, my bed cover structure with an improved dust ruffle can be used is to just use a fitted bed sheet foundation 54 as a top layer on the bed structure. All of these different combinations allow my dust ruffle 48 to be installed on a bed structure without removing the upper mattress 46 or lifting the box spring 56 of a bed.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In combination, a fitted bed sheet foundation and a dust ruffle, said fitted bed sheet foundation comprising: A sheet of material, said sheet of material adapted to fit on and around corners and edges of a mattress, said sheet having first portions which are adapted to fit on and around the head and foot portions and elastically around the four corners of a mattress, the sheet having extended second portions adjacent the first portions and being separated from the first portions so as to be able to extend downwardly over a box spring while the first portions are in securement about a mattress, and a first fastening means, said first fastening means being secured at outer sides on the second portions of the sheet;

said dust ruffle comprising: a sheet of dust ruffle material, a band of flat material, said band of flat material extends from an upper edge of the dust ruffle material, and a second fastening means, said second fastening means being secured on an inner side along the upper edge of the band of flat material, said second fastening means being spaced in such relation so that the second fastening means of the inner side of the dust ruffle is securable to the first fastening means by a person's fingers a desired distance under a mattress in between a mattress and a box spring, the desired distance being sufficient to allow a user to tuck at least one bed sheet or bed cover in a gap defined between the lowermost edge area of the sheet and the upper edge area of the dust ruffle, thereby providing a fitted bed sheet foundation and dust ruffle for placement onto a mattress and around a box spring of a bed that is easy to install and remove on a mattress foundation.

2. The combination of claim 1 wherein said first fastening means on the fitted bed sheet foundation and said second fastening means on the dust ruffle comprise hook and loop type fastening material.

3. The combination of claim 2 wherein said first fastening means on the fitted bed sheet foundation comprises loop type fastening material and said second fastening means on the dust ruffle comprises hook type fastening material.

4. The combination of claim 2 wherein when said hook and loop type fastening material is secured together the secured hook and loop type fastening material has a desired stiffness, whereby when said first fastening means on the fitted bed sheet foundation are secured with said second fastening means on the dust ruffle, the upper edge of the band of flat material and the second portions of the fitted bed sheet foundation can be tucked by a person's fingers a desired distance under the mattress providing a reverse bent edge on the band of flat material of the dust ruffle in between the mattress and the box spring, wherein the combination of the stiffness of the hook and loop type fastening material, the reverse bent edge on the band of flat material and a weight of the mattress create a more secure attachment between the hook and loop type fastening material and a resistance from pulling the dust ruffle out of an adjusted position.

5. The combination of claim 1 wherein said first fastening means on the fitted bed sheet foundation are aligned with said second fastening means on the dust ruffle whereby when the first fastening means are secured with the second fastening means the dust ruffle is then properly aligned along an outer edge of a bed.

6. The combination of claim 1 wherein said dust ruffle is adapted to extend along three edges of a box spring on an end of the box spring opposite to a head end of a bed.

7. The combination of claim 1 wherein said sheet of dust ruffle material has an external decorative configuration.

8. The combination of claim 1 wherein said sheet of material is a sheet of material selected from the group of a fitted bed dust ruffle foundation, a fitted mattress pad dust ruffle foundation, or a fitted bed sheet dust ruffle foundation, said fitted bed dust ruffle foundation comprising a sheet of flat material for placement on a mattress as a lowermost fitted sheet on a bed, said fitted mattress pad dust ruffle foundation comprising a sheet of padded material for placement on a mattress underneath a fitted bed sheet for a bed, and said fitted bed sheet dust ruffle foundation comprising a sheet of flat material for placement on a mattress as an uppermost fitted sheet on a bed.

9. The combination of claim 1 wherein said second portions are slightly shorter in length than a length of the fitted bed sheet foundation and the second portion being centrally positioned along an outer edge of the fitted bed sheet foundation, thereby allowing the second portion of the fitted bed sheet foundation to be tucked in and removed from between the mattress and the box spring without disrupting an adjusted position of the fitted bed sheet foundation and also allowing space for a top bed sheet to be tucked in between the mattress and the box spring at a foot end of the bed.

10. A bed sheet structure for installation on a mattress foundation to avoid any need to remove an upper mattress therefrom and to avoid any need for lifting a mattress foundation, said bed sheet structure comprising a fitted bed sheet foundation and a dust ruffle, said fitted bed sheet foundation comprising: A sheet of material, said sheet of material adapted to fit on and around corners and edges of a mattress, said sheet having first portions which are adapted to fit on and around the head and foot portions and elastically around the four corners of a mattress, the sheet having extended second portions adjacent the first portions and being separated from the first portions so as to be able to extend downwardly over a box spring while the first portions are in securement about a mattress, and a first fastening means, said first fastening means being secured at outer sides on the second portions of the sheet;

said dust ruffle comprising: a sheet of dust ruffle material, a band of flat material, said band of flat material extends from an upper edge of the dust ruffle material, and a second fastening means, said second fastening means being secured on an inner side along the upper edge of the band of flat material, said second fastening means being spaced in such relation so that the second fastening means of the inner side of the dust ruffle is securable to the first fastening means by a person's fingers a desired distance under a mattress in between a mattress and a box spring, the desired distance being sufficient to allow a user to tuck at least one bed sheet or bed cover in a gap defined between the lowermost edge area of the sheet and the upper edge area of the dust ruffle, thereby providing a fitted bed sheet foundation and dust ruffle for placement onto a mattress and around a box spring of a bed that is easy to install and remove on a mattress foundation.

11. The bed sheet structure of claim 10 wherein said first fastening means on the fitted bed sheet foundation and said second fastening means on the dust ruffle comprise hook and loop type fastening material.

12. The bed sheet structure of claim 11 wherein when said hook and loop type fastening material is secured together the secured hook and loop type fastening material has a desired stiffness, whereby when said first fastening means on the fitted bed sheet foundation are secured with said second fastening means on the dust ruffle, the upper edge of the band of flat material and the second portions of the fitted bed sheet foundation can be tucked by a person's fingers a desired distance under the mattress providing a reverse bent edge on the band of flat material of the dust ruffle in between the mattress and the box spring, wherein the combination of the stiffness of the hook and loop type fastening material, the reverse bent edge on the band of flat material and a weight of the mattress create a more secure attachment between the hook and loop type fastening material and a resistance from pulling the dust ruffle out of an adjusted position.

13. The bed sheet structure of claim 10 wherein said dust ruffle is adapted to extend along three edges of a box spring on an end of the box spring opposite to a head end of a bed.

14. The bed sheet structure of claim 10 wherein said sheet of material is a fitted bed dust ruffle foundation, said fitted bed dust ruffle foundation comprising a sheet of flat material for placement on a mattress as a lowermost fitted sheet on a bed.

15. The bed sheet structure of claim 10 wherein said sheet of material is a fitted mattress pad dust ruffle foundation, said fitted mattress pad dust ruffle foundation comprising a sheet of padded material for placement on a mattress underneath a fitted bed sheet for a bed.

16. The bed sheet structure of claim 10 wherein said sheet of material is a fitted bed sheet dust ruffle foundation, said fitted bed sheet dust ruffle foundation comprising a sheet of flat material for placement on a mattress as an uppermost fitted sheet on a bed.

17. The bed sheet structure of claim 10 wherein said sheet of dust ruffle material is wide enough to cover a space between said mattress and a supporting floor surface.

18. The bed sheet structure of claim 10 wherein said second portions are slightly shorter in length than a length of the fitted bed sheet foundation and the second portion being centrally positioned along an outer edge of the fitted bed sheet foundation, thereby allowing the second portion of the fitted bed sheet foundation to be tucked in and removed from between the mattress and the box spring without disrupting an adjusted position of the fitted bed sheet foundation and also allowing space for a top bed sheet to be tucked in between the mattress and the box spring at a foot end of the bed.

19. In combination, a bed structure including a mattress and a box spring, a fitted bed sheet foundation and a dust ruffle, said fitted bed sheet foundation and dust ruffle being capable of installation on the bed to avoid any need to remove the mattress therefrom, said fitted bed sheet foundation comprising: A sheet of material, said sheet of material adapted to fit on and around corners and edges of a mattress, said sheet having first portions which are adapted to fit on and around the head and foot portions and elastically around the four corners of a mattress, the sheet having extended second portions adjacent the first portions and being separated from the first portions so as to be able to extend downwardly over a box spring while the first portions are in securement about a mattress, and a first fastening means, said first fastening means being secured at outer sides on the second portions of the sheet;

said dust ruffle comprising: a sheet of dust ruffle material, a band of flat material, said band of flat material extends from an upper edge of the dust ruffle material, and a second fastening means, said second fastening means being secured on an inner side along the upper edge of the band of flat material, said second fastening means being spaced in such relation so that the second fastening means of the inner side of the dust ruffle is securable to the first fastening means by a person's fingers a desired distance under a mattress in between a mattress and a box spring, the desired distance being sufficient to allow a user to tuck at least one bed sheet or bed cover in a gap defined between the lowermost edge area of the sheet and the upper edge area of the dust ruffle, thereby providing a fitted bed sheet foundation and dust ruffle for placement onto a mattress and around a box spring of a bed that is easy to install and remove on a mattress foundation.

20. The combination of claim 19 wherein said first fastening means on the fitted bed sheet foundation and said second fastening means on the dust ruffle comprise hook and loop type fastening material.

21. The combination of claim 20 wherein when said hook and loop type fastening material is secured together the secured hook and loop type fastening material has a desired stiffness, whereby when said first fastening means on the fitted bed sheet foundation are secured with said second fastening means on the dust ruffle, the upper edge of the band of flat material and the second portions of the fitted bed sheet foundation can be tucked by a person's fingers a desired distance under the mattress providing a reverse bent edge on the band of flat material of the dust ruffle in between the mattress and the box spring, wherein the combination of the stiffness of the hook and loop type fastening material, the reverse bent edge on the band of flat material and a weight of the mattress create a more secure attachment between the hook and loop type fastening material and a resistance from pulling the dust ruffle out of an adjusted position.

22. The combination of claim 19 wherein said dust ruffle extends along three edges of a box spring on an end of the box spring opposite to a head end of a bed.

* * * * *